US005316354A

United States Patent [19]

Arabia, Jr. et al.

[11] Patent Number: 5,316,354

[45] Date of Patent: May 31, 1994

[54] LOOP STRIKER

[75] Inventors: Frank J. Arabia, Jr., Shelby Township, Macomb County; Thomas A. Dzurko, Mt. Clemens, both of Mich.

[73] Assignee: General Motors Corporation, Detroit, Mich.

[21] Appl. No.: 25,429

[22] Filed: Mar. 1, 1993

[51] Int. Cl.[5] ..... E05B 15/02

[52] U.S. Cl. ..... 292/340; 292/DIG. 41

[58] Field of Search ..... 292/216, 340, DIG. 41, 292/DIG. 40, 341.12, DIG. 73

[56] References Cited

U.S. PATENT DOCUMENTS 3,331,624 7/1967 Pugh ..... 292/216
3,709,537 1/1973 Kazaoka et al. ..... 292/216
4,097,078 6/1978 Tack et al. ..... 292/216
4,172,768 10/1979 Cerdan ..... 292/216
4,998,759 3/1991 Peterson et al. ..... 292/340
5,209,532 5/1993 Nakamura et al. ..... 292/340 X

*Primary Examiner*—Richard E. Moore
*Attorney, Agent, or Firm*—Charles E. Leahy

[57] ABSTRACT

A loop striker for use with a vehicle closure latch having a rotatable fork bolt that traps a leg of the loop striker when the fork bolt is in a latched position includes a base having a pair of laterally spaced legs that is adapted for securement to a support, a cross bar that is spaced from the base and attached to the pair of laterally spaced legs, and a tab at one end of the cross bar that overhangs the trapped leg to prevent the fork bolt from walking around the corner of the loop at the end of the trapped leg.

2 Claims, 2 Drawing Sheets

LOOP STRIKER

BACKGROUND OF THE INVENTION

This invention relates to strikers for vehicle closure latches and more particularly to a vehicle closure latch striker of the loop type.

U.S. Pat. No. 4,756,563 granted to Stephen K. Garwood and Jeffrey L. Konchan Jul. 12, 1988 is incorporated in this patent specification by reference. This patent discloses a vehicle door latch 10 that includes a rotatable fork bolt 58 that cooperates with a loop type striker 144. The striker 144 includes a pair of legs 146 which are secured in a conventional manner, such as heading over, to a mounting plate 148. The bight portion of the striker is partially flattened on opposites sides and a plastic wedge 154 is molded to the bight portion 150 in a conventional molding operation. As the vehicle door is closed, the leading leg 146 of the striker 144 engages the trailing or outboard edge of the throat 86 of the fork bolt 58 and rotates it to a latched position Where the leading leg 146 of the striker 144 is trapped within the throat 86 as shown in FIG. 1 of the patent. In the latched position, the metal bight portion 150 and the molded over plastic wedge 154 fit behind the fork bolt 58 in a wedge shaped slot formed by metal plate 160 and wall 162. There is a substantial portion of the metal bight portion 150 behind the metal fork bolt 58 on the inboard side of the trapped striker leg 146. However, there is little if any portion of the metal bight portion 150 behind the metal fork bolt 58 on the outboard side of the trapped striker leg 146 when the fork bolt 58 is the latched position.

General Motors Corporation, assignee of the above patent, has also manufactured the patented door latch with a plastic coated fork bolt and a cooperating loop type striker having a metal wedge. In this modification, there is at best still an insignificant portion of the metal wedge behind the metal insert of the fork bolt on the outboard side of the trapped striker leg when the fork bolt is in the latched position. This modification is discussed further in the detailed description of the invention.

In side intrusion testing according to federal motor vehicle safety standard (FMVSS) 214, the end of the vehicle door and the door latch attached to it on certain vehicles, tend to pivot about a vertical axis while the door pillar and the striker attached to it tend to remain stationary due to the construction of the door and the door pillar. In such a situation, the fork bolt tends to walk around the corner at the end of a trapped leg of a loop type striker so that the integrity of the door latch system depends upon the lateral strength of the door latch system.

Every door latch system has a lateral strength and a longitudinal strength. The lateral strength is the resistance of the door latch system to being pulled apart in a lateral or side-wise direction of the trapped striker leg. The longitudinal strength on the other hand is the resistance of the door latch system to being pulled apart in a longitudinal or length-side direction of the trapped striker leg. The longitudinal strength of a given door latch system is generally greater than its lateral strength.

One way to achieve increased strength of the door latch system in the above situation where the fork bolt tends to walk around the corner of a loop type striker is to increase the gauge of the metal used in the weaker parts of the door latch system to increase the lateral strength of the door latch system. A drawback to this solution is that it may increase space requirements and/or manufacturing costs in a significant way.

SUMMARY OF THE INVENTION

The object of this invention is to provide a loop striker that maintains a substantially perpendicular relationship between the trapped leg of the striker and an entrapping fork bolt of a cooperating vehicle closure latch so that the integrity of the door latch system depends primarily on the longitudinal strength of the door latch system in an intrusion type test according to FMVSS 214. Thus the strength of the closure latch system is automatically increased to the longitudinal strength of the door latch system in this testing situation without any possible need for increasing the size, the metal gauge of any part or the manufacturing cost of the door latch system in a significant way to increase the lateral strength of the door latch system.

A feature of the loop striker of the invention is that the loop striker has a metal cross bar that extends outwardly of its trappable leg a sufficient distance so as to prevent an entrapping fork bolt of a cooperating closure latch from walking around the corner of the loop at the end of the trapped leg under intrusion testing type conditions.

Another feature of the loop striker of the invention is that the loop striker has a metal cross bar that is attached to the ends of longitudinally spaced legs of the striker and that has a tab at one end that extends outwardly of the trappable leg of the striker a significant distance in the longitudinal direction.

Another feature of the loop type striker of the invention is that the loop striker has a metal cross bar that is attached to the ends of longitudinally spaced legs of the striker and that has a longitudinal tab at one end that extends outwardly of the trappable leg of the striker a substantially greater distance in the longitudinal direction than it does in the lateral direction.

Still another feature of the loop type striker of the invention is that the loop striker has a metal cross bar that is attached to the ends of longitudinally spaced legs of the striker and that has a rectangular tab at one end that extends outwardly of the trappable leg of the striker a substantially greater distance in the longitudinal direction than it does in the lateral direction so as to produce a significant overlap with a cooperating fork bolt within the confines of a receiving slot of the door latch.

Still yet another feature of the loop type striker of the invention is that the loop striker has a wedge shaped metal cross bar that has a rectangular tab at one end that extends outwardly of the trappable leg of the striker a significant amount in the longitudinal direction and that is symmetrical for use in right hand and left hand installations.

BRIEF DESCRIPTION OF THE DRAWINGS

The above and other objects, features and advantages of the invention will become more apparent from the following description taken in conjunction with the accompanying drawings wherein like references refer to like parts and wherein.

DESCRIPTION OF THE INVENTION

Figure 1:
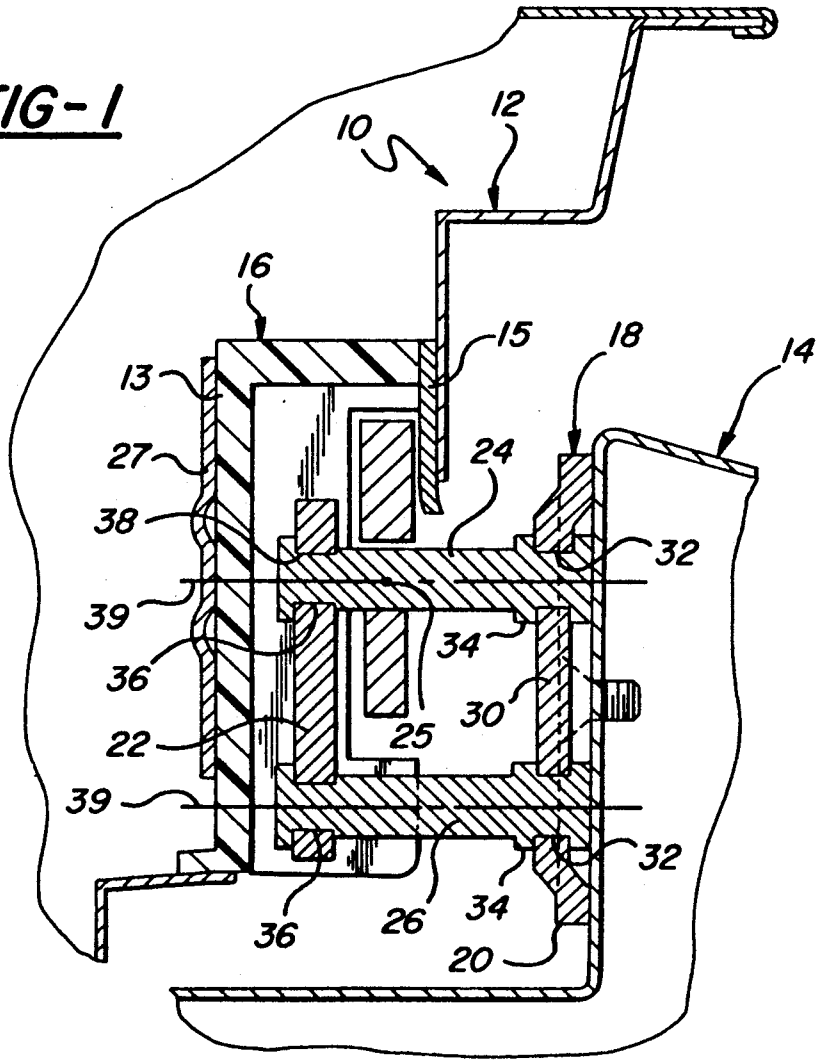
FIG. 1 is a horizontal section of a vehicle showing a loop striker in accordance with the invention installed in a vehicle.

Referring now to the drawing, FIG. 1 shows an automotive vehicle 10 that has a door 12 is hinged on a front or "A" pillar of the vehicle body (not shown) for closing an opening between the "A" pillar and a "B" pillar 14 at the back of the door opening. A vehicle door latch 16 is mounted inside the door 12 at the back end. The door latch 16 is illustrated somewhat schematically in the interests of clarity. However, construction details of a suitable latch are shown in U.S. Pat. No. 4,756,563 granted to Stephen K. Garwood and Jeffrey L. Konchan Jul. 12, 1988 which has been incorporated in this patent specification by reference.

When the door 12 is closed, the door latch 16 engages a loop striker 18 of this invention that is attached to the "B" pillar 14 to latch the door 12 in the closed position.

Figure 4:
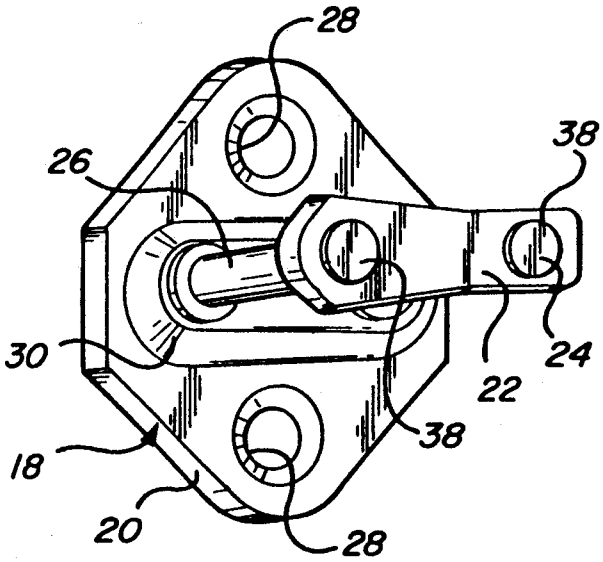
FIG. 4 is a perspective view of the loop striker of this invention that is shown in FIGS. 1 and 2.

As best shown in FIGS. 1 and 4, the loop striker 18 comprises a base plate 20, a wedge shaped cross bar 22 and a pair of round legs 24 and 26 that are all made of a strong metal such as steel. The base plate 20 has two countersunk holes 28 for securing the loop striker 18 to the "B" pillar and a central embossment 30 that has two laterally spaced holes 32.

The round legs 24 and 26 have collars 34 at one end and necks 36 at the other end. The round legs 24 and 26 are secured to the base plate 20 by inserting their respective collared ends into the laterally spaced holes 32 and heading the ends over so that the edges of the embossment 30 around the holes 32 are tightly clamped between the collars 34 and the formed heads beneath the base plate.

Figure 2:
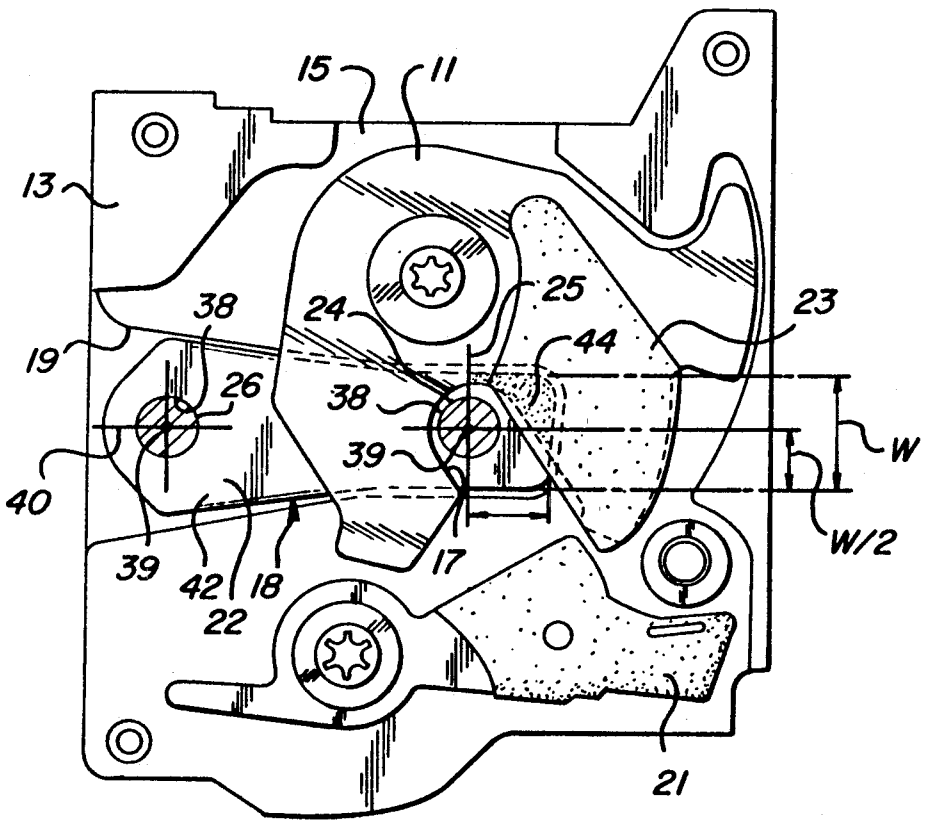
FIG. 2 is section taken along the line 2—2 of FIG. 1 looking in the direction of the arrows.

The cross bar 22 has a pair of longitudinally spaced holes 38 that have axes or centerlines 39 that lie in and define an imaginary longitudinal center plane 40 of the cross bar 22 as shown in FIG. 2. The cross bar 22 is attached to the opposite ends of the round legs 24 and 26 by inserting their respective necks 36 into the longitudinally spaced holes 38 and heading the ends over so that the edges of the cross bar 22 around the holes 38 are tightly clamped between the shoulders defined by the necks 36 and the formed heads on top of the cross bar 22.

The cross bar 22 has a wedge shaped portion 42 at one end and a longitudinal tab 44 at the other end that extends outwardly of the round leg 24 a substantial distance so that the tab 44 maintains the round leg 26 substantially perpendicular to the lock bolt of the door latch 16 when it is trapped in a latched position in the door latch 16.

Figure 3:
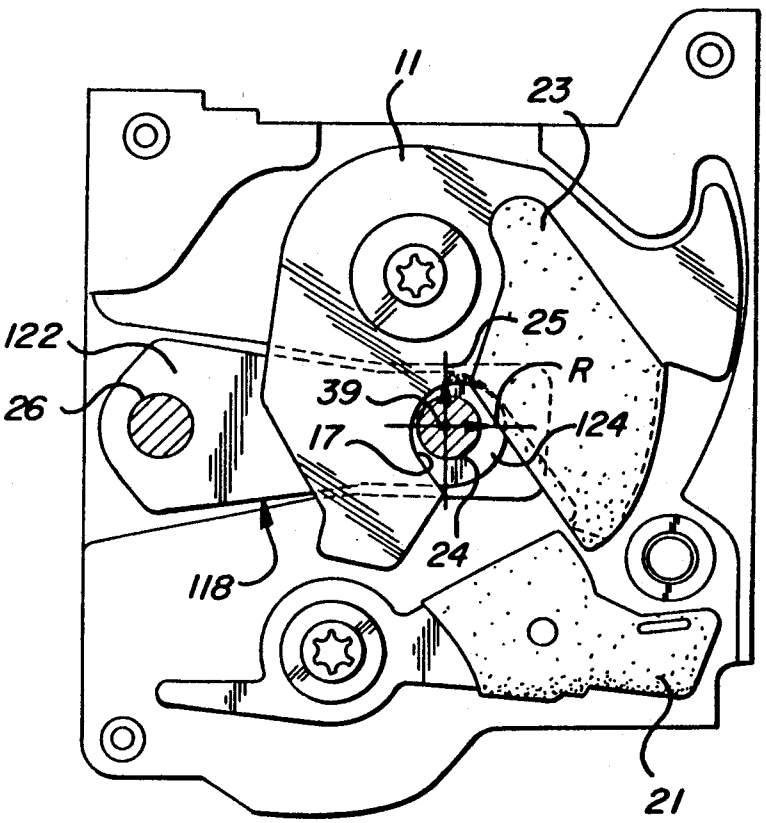
FIG. 3 is a view similar to FIG. 2 showing a prior art loop striker.

The door latch 16 is well known as indicated above and consequently need only be described briefly. As shown in FIGS. 1 and 3, the door latch 16 comprises a fork bolt 11 that is rotatably mounted in a housing 13 that is closed by a face plate 15. The fork bolt 11 has a slot or throat 17 that receives and traps round leg 24 of the striker 18 when it engages the door latch 10. The housing 13 includes a bell mouth slot 19 behind the fork bolt 11 which receives the cross bar 27 and guides the round leg 27 into a proper position in the housing 13. FIGS. 2 and 3 show the fork bolt 11 retained in the latched position by a detent lever 21 that is rotatably mounted in the housing 13 and spring biased to the retaining position shown. The fork bolt is initially in an unlatched position (not shown) which is rotated about 60 degrees clockwise from the latched position shown. When the striker 18 enters the door latch 10, via the bell mouth slot 19, the leading leg 24 engages the back of the throat 17 and rotates the fork bolt 11 to the latched position shown. The striker 18 and the fork bolt 11 are both made of a strong metal such as steel. The fork bolt 11, however, includes a plastic coating 23 to quiet operation as the leading leg 24 strikes and rotates the fork bolt 11 to the latched position.

When the vehicle door 12 of certain vehicles is subjected to an intrusion type test, the fork bolt 11 tends to walk around the corner at the end of the round leg 24 by pivoting substantially about a vertical axis 25 that intersects the centerline of the round leg 24 as indicated by the arrow 27 in FIG. 1. When this occurs, the door latch system resists being pulled apart primarily due to its lateral strength in the plane of the fork bolt 11. However, the longitudinal strength of the door latch system perpendicular to the fork bolt 11 is generally significantly greater. Consequently, the integrity of the door latch system can be enhanced by preventing the fork bolt 11 from walking around the corner at the end of the round leg 24, or in other words, by maintaining the round leg 24 substantially perpendicular to the fork bolt 11.

This is accomplished by the longitudinal tab 44 which extends the support for the latch bolt 11 on the outboard side of the centerline 39 (and vertical axis 25) and which increases the overlap between the crossbar 22 and the metal part of the fork bolt 11 on the outboard side of the centerline significantly. This is demonstrated by comparing the respective relationships of the loop striker 18 of this invention shown in FIGS. 1, 2 and 4 and the prior art loop striker shown in FIG. 3 with the fork bolt 11.

Referring first to FIG. 2 and the loop striker 18 of this invention, the longitudinal tab 44 is generally rectangular with rounded edges at the end of the cross bar 22. The tab 44 has an width W which is greater that the diameter of the round leg 24 so that the tab 44 extends outwardly of the round leg 26 in the lateral direction and the cross bar 22 overhangs the fork bolt 11 in the lateral direction that is in the direction of the vertical axis 25, as shown in FIG. 2. The width W and the lateral extension W/2 measured from the centerline 39 however, are limited by the bell mouth slot 19 in the housing 13 of door latch 10 that receives the loop striker 18 when the vehicle door 12 is closed. However, the length of the longitudinal tab in the direction of the longitudinal center plane 40 is not nearly so limited. Consequently the tab 44 has a longitudinal extension L measured from the centerline 39 that is substantially larger than its lateral extension W/2. This longitudinal extension L enhances the integrity of the door latch system by preventing the fork bolt 11 from walking around the corner at the end of the round leg 24, or in other words, by maintaining the round leg 24 substantially perpendicular to the fork bolt 11 in two way as indicated above. Firstly the longitudinal extension L increases the support for the fork bolt 11 on the outboard side of the centerline 39 so that it provides substantial leverage in resisting pivoting of the fork bolt 11 about the vertical axis 25. Secondly it increases the overlap (which is shaded in FIG. 2) between the crossbar 22 and the metal part of the bolt on the outboard part of the centerline significantly.

Referring now to the prior art and FIG. 3 which is a view similar to FIG. 2, a prior art loop type striker and door latch arrangement like that of U.S. Pat. No. 4,756,563 granted to Stephen K. Garwood and Jeffrey L. Konchan Jul. 12, 1988 but which has been modified as described in the introduction is shown. The door latch 16 is identical to that shown in FIG. 2 and corresponding parts are identified with the same numerals. The common parts of the loop striker 18 of this invention and the prior art striker 118 are also identified with the same numerals. The difference in the prior art striker 118 lies primarily in the cross bar 122 which has a round nose 124 of uniform radius R at the insertion end. Consequently the lateral extension and the longitudinal extension of the nose 129 are identical and both equal to the radius R. This produces very little support for the fork bolt 11 on the outboard side of the centerline 39 for resisting rotation of the fork bolt 11 about the vertical axis 25 and the overlap of the cross bar 122 and the fork bolt 11 on the outboard side of the trapped round leg 24 (which is shaded) is insignificant.

In comparison, the cross bar 22 of the loop striker 18 of the invention increases the support for the fork bolt 11 on the outboard side of the centerline 39 substantially and substantially increases the overlap of the cross bar 22 behind the fork bolt 11 on the outboard side of the trapped round leg 24 (which is shaded in FIG. 2). Moreover the rectangular shape maximizes the overlap within the confines of the bell mouth slot 19.

By way of example, I have found that a loop striker with round 7.5 mm diameter legs that had a cross bar of 4.5 mm thickness wherein the tab had a width W of 11 mm and an extension L of 8 mm would maintain the trapped leg substantially perpendicular to the fork bolt 11 during an intrusion type test of the above noted type so that the intrusion force was resisted primarily by the longitudinal strength of the door latch system. Consequently the latch system could maintain its integrity even if the theoretical lateral strength is exceeded by taking advantage of the inherently higher longitudinal strength of the door latch system.

It should also be noted that the cross bar 22 is also preferably symmetrical about the longitudinal center plane 40 so that the loop striker 18 of the invention is non handed, that it, so that it can be used in conjunction with door latches on either the right side or the left side of the vehicle.

The invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. A loop striker for use with a door latch having a wedge shaped mouth for receiving a cross bar and a leading leg of a loop striker and a rotatable fork bolt that traps the leading leg of the loop striker in a throat of the fork bolt and the cross bar of the loop striker behind the fork bolt when the fork bolt is in a latched position, comprising;

a base having a pair of laterally spaced legs that is adapted for securement to a support so that the laterally spaced legs are centered on a longitudinal center plane and the leading leg is located to be received in the wedge shaped mouth of the door latch, the cross bar being spaced from the base and attached to the pair of laterally spaced legs, the leading leg being at an end of the cross bar that has a tab that extends beyond the one leg by a substantial amount so that the tab maintains the leading leg substantially perpendicular to a fork bolt of a door latch when it is trapped in a latched position in the door latch, the cross bar having a wedge shaped portion at the opposite end that engages a wedge shaped mouth of a door latch for locating the leading leg in the door latch, and the tab having a longitudinal extension measured from a centerline of the leading leg which is greater than the lateral extension of the tab from the centerline so as to produce a significant overlap within the confines of the slot, between respective parts of the cross bar and the fork bolt that are outboard of the centerline when the fork bolt is in the latched position.

2. The loop striker as defined in claim 1 wherein the tab is generally rectangular with rounded edges to maximize the overlap and the cross bar is symmetrical about the longitudinal center plane so that the loop striker can be used in conjunction with door latches on either the right side or the left side of the vehicle.

* * * * *